United States Patent [19]

Dimier

[11] Patent Number: 4,538,828

[45] Date of Patent: Sep. 3, 1985

[54] SAFETY SKI BINDING

[75] Inventor: Jean-Pierre Dimier, Rumilly, France

[73] Assignee: Salomon S.A., Annecy, France

[21] Appl. No.: 478,251

[22] Filed: Mar. 24, 1983

[30] Foreign Application Priority Data

Mar. 25, 1982 [FR] France ..... 82 05073

[51] Int. Cl.[3] ..... A63C 9/08

[52] U.S. Cl. ..... 280/628

[58] Field of Search ..... 280/11, 31, 628, 629, 280/630, 631

[56] References Cited

U.S. PATENT DOCUMENTS

| | | | |
|---|---|---|---|
| 4,243,246 | 1/1981 | Weigl | 280/628 |
| 4,365,822 | 12/1982 | Nitschko | 280/628 |
| 4,434,997 | 3/1984 | Nitschko | 280/628 |

FOREIGN PATENT DOCUMENTS

| | | |
|---|---|---|
| 2030749 | 12/1971 | Fed. Rep. of Germany . |
| 2099849 | 3/1972 | France . |
| 2210422 | 7/1974 | France . |
| 2314742 | 1/1977 | France . |
| 2334382 | 7/1977 | France . |
| 2385418 | 10/1978 | France . |
| 2420359 | 10/1979 | France . |
| 2419737 | 10/1979 | France . |
| 2424037 | 11/1979 | France . |
| 2458299 | 1/1981 | France . |
| 2469189 | 5/1981 | France . |
| 2478476 | 9/1981 | France . |

*Primary Examiner*—Richard A. Bertsch

*Attorney, Agent, or Firm*—Sandler & Greenblum

[57] ABSTRACT

A safety ski binding releasably holding a boot on a ski. The binding includes a jaw adapted to hold the boot and to pivot laterally, and an elastic mechanism biasing the jaw against lateral pivoting. When vertical stress acts on the binding, friction is generated which further biases the jaw against lateral pivoting, thereby preventing lateral release of the boot when dangerous lateral stress acts on the boot. To counteract this friction, a compensation mechanism is provided which counteracts the increased biasing against lateral pivoting both in the event upward vertical stresses act on the boot and in the event downward vertical stresses act on the boot. In one embodiment the compensation mechanism includes a pair of toggles which reduce the bias of the elastic mechanism in response to the upward pivoting of the jaw so that a constant bias against lateral pivoting is maintained on the jaw when vertical stress acts on the binding. In this embodiment a sensor is provided for converting downward directed stress to upward directed stress acting on the jaw. In another embodiment, the jaw pivots around two lines of support converging above the ski, so that any upward stress on the jaw has a component in the direction of lateral pivoting so as to increase the lateral pivoting force to compensate for the friction. Also provided in this embodiment is a sensor for converting downward directed stress to upward directed stress acting on the jaw.

39 Claims, 18 Drawing Figures

SAFETY SKI BINDING

FIELD OF THE INVENTION

The present invention relates to a safety ski binding for holding a ski boot to a ski, and specifically for holding one end of the boot in a laterally releasable manner.

BACKGROUND OF THE INVENTION

A common type of safety binding, called a "toe binding for holding the front of the boot" ensures the safety of a skier by responding to excessive torsional forces on the leg of the skier by laterally pivoting and releasing the boot from the ski. In these types of bindings, the pivoting of the boot in a lateral direction is performed against the bias of an elastic mechanism whose bias is adjusted to a predetermined value.

These traditional lateral release type skis suffer certain disadvantages particularly when a fall due to lateral torsional stress is combined with stresses causing the skier to fall backwards. When this occurs, the front of the boot exerts an upward force on a sole gripping element of the binding disposed above the sole of the boot. This upward force generates interference frictional forces between the edge of the sole and the sole gripping element. These interference forces bias the jaw against lateral pivoting and release the boot. Thus, the total force necessary for lateral pivoting and release of the boot is greatly increased and the skier's leg suffers abnormal torsional forces which might result in the leg being broken.

In response to this problem, means for improving the release were sought. Safety ski bindings having sole gripping elements that are sensitive to upward biases caused by the front of the boot so as to lessen the resistance of the bindings to lateral release have been proposed. These bindings, called compensation bindings, provide the most constant bias against lateral pivoting regardless of the type of fall. Examples of some of these bindings are described in French Pat. Nos. 75 19 439, 77 09 363 and 78 12 741 of the applicant. The interference forces in these bindings is compensated for the use of a sensor comprising a sole gripping element which, when pulled upward by the boot, decreases the bias against lateral pivoting of the elastic mechanism.

Other examples of compensation bindings are described in French Pat. Nos. 75 37 908, 78 07 805, 79 14 484 and 80 06 365 of the applicant. These bindings include a jaw which holds the front of the boot and which is adapted to pivot around either one of two support lines converging at a point above the ski. In these bindings, the jaw does not decrease the bias of the elastic mechanism; rather compensation is accomplished by the movement of the jaw itself. Upward stress on the jaw has a component in the direction of lateral pivoting around one of the two lines of support, thereby creating a lateral motor force which is combined with other lateral stress on the jaw. This motor force counters the interference friction force, and in this way, compensation is achieved.

These known compensation bindings improved safety considerably. However they still suffer shortcomings because they do not ensure compensation for interference forces in the event of a backward fall, that is, when the front of the boot lifts up and exerts an upward force on the jaw holding the boot, and in the event of a forward fall, where the bottom of the sole is forced against the ski. In a forward fall a large force is directed downward towards the ski thereby creating a large frictional force between the bottom of the sole and the support surface of the sole. This friction biases the jaw against lateral release of the boot and lateral pivoting.

There have been many attempts to eliminate or to reduce as much as possible the friction between the front of the sole of the boot and the upper surface of the ski. It has been suggested that a sensor be placed under the front of the boot so as to act on the binding's elastic mechanism to adjust its bias, as described in French Pat. No. 71 22 859. This sensor compensates for the interference forces when it is biased by the front of the boot during a forward fall. It accomplishes this by reducing the elastic mechanism's release threshold value (i.e., the force above which the bias of the elastic mechanism will be overcome and the jaw will laterally pivot). However, such an apparatus is of a limited value because it only compensates for frictional forces during a forward fall. As a consequence, when torsional forces causing a lateral twisting of the leg and a fall are combined with forces causing a backward fall the resulting situation becomes very dangerous to the skier. Interference frictional forces are not compensated for, thereby increasing the threshold for lateral release of the boot to a dangerous level. If the torsional forces are high, the leg may be broken.

Thus there is a need for a binding which compensates for interference frictional forces which occur during a backward fall as well as a forward fall. There is also a need for a binding having a reliable adjustment of the lateral release threshold, regardless of the direction of the fall.

SUMMARY OF THE INVENTION

It is an object of the present invention to provide a safety binding which compensates for interference friction forces which occur during a backward fall as well as a forward fall.

It is another object of the present invention to provide a binding having a particularly reliable adjustment of the lateral release threshold, regardless of the direction of the fall.

These and other objects of the present invention are achieved by a safety ski binding holding a ski boot on a ski in a laterally releasable manner. The binding comprises a jaw which holds one end of the boot and is adapted to laterally pivot. The binding also includes an elastic locking mechanism which biases the jaw against lateral pivoting. Thus, lateral release and pivoting of the jaw occur against the bias of the elastic locking mechanism. Also provided is a compensation means to compensate for frictional interference forces which adds to the bias of the jaw against lateral pivoting. These interference forces are generated when the jaw is subjected to vertical stress. The compensation means comprises a sensor responsive to any upward movement of the front of the boot so as to decrease, as a function of the intensity of this upward movement, the bias of the locking mechanism, thereby maintaining the bias against lateral pivoting of the binding at a substantially constant level. A binding also includes a second sensor located beneath the boot and responsive to downward movement of the boot, so as to also decrease the bias of the elastic mechanism.

Thus, the safety binding of the invention ensures the complete safety of the skier when he falls forward or backwards and when this fall is combined with torsional forces also causing him to fall. This is accomplished by a particularly simple means: one compensation means is activated by two sensors detecting, respectively, upward and downward stresses. In a first embodiment, the compensation means acts on the elastic locking mechanism.

In this first embodiment, the safety binding comprises a jaw, an elastic system and a bias maintenance means. The jaw is adapted to hold at least a portion of the boot and is adapted to laterally pivot. The elastic system biases the jaw against lateral pivoting. The bias maintenance means maintains the total bias on the jaw against lateral pivoting at substantially the same level both in the event upward directed vertical stress acts on the binding, downwardly directed vertical stress acts on the binding, and no vertical stress acts on the binding. The bias maintenance means is adapted to reduce the bias caused by the elastic system when upward directed vertical stress acts on the binding and when downward directed vertical stress acts on the binding, so as to counteract the effect of frictional interference forces that are generated when vertical stress acts on the binding.

The binding further includes a support on which the elastic system is adapted to act to produce a force for biasing the jaw against lateral pivoting. The bias maintenance means further comprises a toggle means for transmitting substantially all of the force from the elastic system to the support when no vertical stress acts on the jaw and for transmitting less than all of the force from the elastic system to the support when vertical stress acts on the jaw.

The toggle means comprises a first toggle adapted to contact the elastic system and a second toggle adapted to pivot around an axis transverse to the longitudinal axis of the binding, The first toggle is adapted to be journaled on the second toggle. In addition, the jaw includes a sole gripping means for gripping the sole of the boot. Furthermore, the jaw is adapted to pivot upwards around this axis. The toggle means further comprises a crosspiece connected to the jaw on the opposite side of the axis from the sole gripping element and is so positioned that when the jaw pivots upward, the crosspiece forces the first toggle to pivot away from the second toggle.

The toggle means is responsive to the vertical position of the jaw so that when the jaw pivots vertically upward from a centered rest position, the toggle means transmits less than all of the force from the elastic system to the support.

The jaw includes a sole gripping element for gripping the sole of the boot and this sole gripping element comprises a first sensor for detecting upwardly directed vertical forces and activating the toggle means. Also provided is a second sensor adapted to detect downward directed vertical forces and adapted to convert these forces to upward directed vertical forces which act on the first sensor. The second sensor comprises a lever journaled on a pin. A first portion of the lever is adapted to be disposed between the sole of the boot and the ski on one side of the pin, and a second portion of the lever is adapted to be disposed on the other side of the pin under the first sensor. When the boot pivots the first portion of the lever downward, the second portion of the lever pivots upward against the first sensor. The first portion of the lever comprises a pedal having an anti-friction plate on the top thereof which may be convex in shape. The second portion of the lever comprises a projection adapted to be biased against the first sensor by an elastic means. The elastic means may be a spring adapted to be engaged in a recess in the projection.

In an alternative embodiment, the sensor which controls the toggle is a vertical stress detecting means for detecting upward directed stress which is adapted to pivot upward in response to vertical stress. The amount of force transmitted by the toggle means is determined by the vertical position of the vertical stress detecting means. When the vertical stress detecting means is in a centered rest position, the first and second toggles abut one another. When the detecting means pivots upward away from its centered rest position, the first toggle pivots away from the second toggle. A portion of the detecting means called a boot contacting portion is adapted to contact the boot and the detecting means is further designed to pivot around an axis. In addition, the binding further includes a crosspiece connected to the detecting means on the side of the axis opposite from the boot contacting position. The crosspiece is so positioned that when the jaw pivots upward, the crosspiece forces the first toggle to pivot away from the second toggle. In this embodiment the jaw includes a sole gripping means for gripping the sole of the boot. The detecting means includes a shoulder adapted to contact the boot, and the detecting means operates independently of the sole gripping element. The detecting means further includes a sensor adapted to sense downward directed vertical forces and adapted to convert these downward directed vertical forces into upward directed vertical forces acting on the detecting means.

The sensor comprises a lever adapted to pivot around an axis. A first portion of the lever on one side of the axis is adapted to be disposed between the ski and the sole of the boot and a second portion of the lever on the other side of the axis is adapted to be disposed between the ski and the detecting means. The second portion of the lever is adapted to be biased by an elastic means against a detecting means.

In another embodiment of the present invention, the binding comprises a jaw, an elastic system and a compensating means. The jaw is adapted to hold at least a portion of the boot and is adapted to pivot laterally. When the jaw experiences vertical stress friction is generated which biases the jaw against lateral pivoting. The jaw is also biased against lateral pivoting by the elastic system. The compensating means causes a compensating lateral force to act on the jaw to compensate for the bias against lateral pivoting caused by the friction. This compensating lateral force is produced both in the event upward vertical stress acts on the jaw and downward vertical stress acts on the jaw.

The compensating means comprises a support attached to the ski and having two lines of support thereon, converging above the ski and a portion of the jaw which is adapted to engage the support. The jaw is adapted to laterally pivot around either of these lines of support. This compensating lateral force is produced when the jaw experiences upward directed vertical stress.

The binding in this embodiment further includes a sensor adapted to detect and transform downward directed vertical stress into upward directed vertical stress acting on the jaw. This sensor comprises a lever adapted to pivot around an axis and having a first portion and a second portion. The first portion of the lever is disposed on one side of the axis and is adapted to be located between the ski and the boot, and the second portion of the lever is on the other side of the axis and is adapted to be disposed between the ski and the jaw. The first portion of the lever comprises a pedal having a convex top portion.

In still another embodiment, the binding comprises a support attached to a ski, and having two lines of support thereon converging above the ski, a holding means for releasably holding a boot to a ski, and a sensor. The holding means is adapted to laterally pivot around either one of two lines of support. When the jaw experiences upward vertical stress, a lateral force is produced urging the jaw to pivot laterally. The sensor detects downward vertical stress and converts this downward vertical stress into an upward vertical stress acting on the jaw.

In still a further embodiment of the present invention, the safety binding comprises a holding means, an elastic system and a compensation means. The holding means releasably holds the boot to the ski and is adapted to pivot laterally. When vertical stress acts on the holding means friction is produced which generates interference forces biasing the holding means against lateral pivoting. The elastic means also biases the holding means against lateral pivoting. The compensation means substantially counteracts the effect of the interference forces both in the case of an upward directed vertical stress acting on the holding means and a downward directed vertical stress acting on the holding means.

The compensation means comprises a first sensor for detecting upward vertical stresses on the holding means and transmitting these upward vertical stresses to the rest of the compensation means. This first sensor comprises a lever adapted to pivot about an axis transverse to the longitudinal axis of the binding. The binding further includes a second sensor for transforming downward directed vertical stress into an upper directed vertical stress acting on this lever. The second sensor comprises a lever adapted to pivot around an axis transverse to the longitudinal axis of the ski. This lever comprises a first portion adapted to be placed under the boot and a second portion on the other side of the axis from the first portion, under the first sensor. This first portion of the lever comprises a pedal having a convex top portion.

In another embodiment, the second sensor comprises a first element, a second element and a third element. The first element is adapted to pivot around an axis transverse to the longitudinal axis of the ski and the second element is adapted to move along the longitudinal axis of the ski in response to pivoting of the first element in response to a downward directed stress. The third element is adapted to vertically move in response to the longitudinal movement of the second element to vertically move a portion of the first sensor. The first element is journaled on the ski and includes a front portion. The second element has first and rear inclined faces, so that the front portion of the first element is adapted to contact the rear incline face of the second element and the front incline face of the second element is adapted to contact the third element. The first element may include an anti-frictional convex top surface. In an alternative embodiment, the third element may comprise a lever having two arms pivoting around an axis transverse to the longitudinal axis of the ski and located between said two arms.

In another embodiment the binding includes a sole gripping element for gripping the sole of the boot and a second sensor for transforming downward directed vertical stress into upward directed vertical stress. The second sensor may comprise a lever having a roller projecting above the center thereof and adapted to contact the sole gripping element. In an alternative embodiment, the second sensor comprises a lever having an inverted V shaped with an apex. The apex of the lever is adapted to contact the sole gripping element. In a still further alternative embodiment, the second sensor comprises a lever journaled on the ski about an axis transverse to the longitudinal axis thereof and having a projection at each transverse end thereof, each adapted to contact said sole gripping element. The sensor further includes a pedal having an anti-friction convex top portion. The pedal is on the opposite side of the axis from the projections and the pedal is adapted to contact the sole gripping element.

BRIEF DESCRIPTION OF THE DRAWINGS

The aforegoing and other objects, features and advantages of the present invention will become more apparent to those of ordinary skill in the art to which the invention pertains in light of the foregoing detailed descriptions of the preferred embodiments, as discussed and illustrated in the accompanying drawings, in which like reference characters designate like or corresponding parts throughout the several embodiments, and wherein:

FIG. 15 is a front view of one embodiment of the second sensor and FIG. 16 is a side view of that same sensor.

DETAILED DESCRIPTION OF THE PREFERRED EMBODIMENTS

Figure 1:
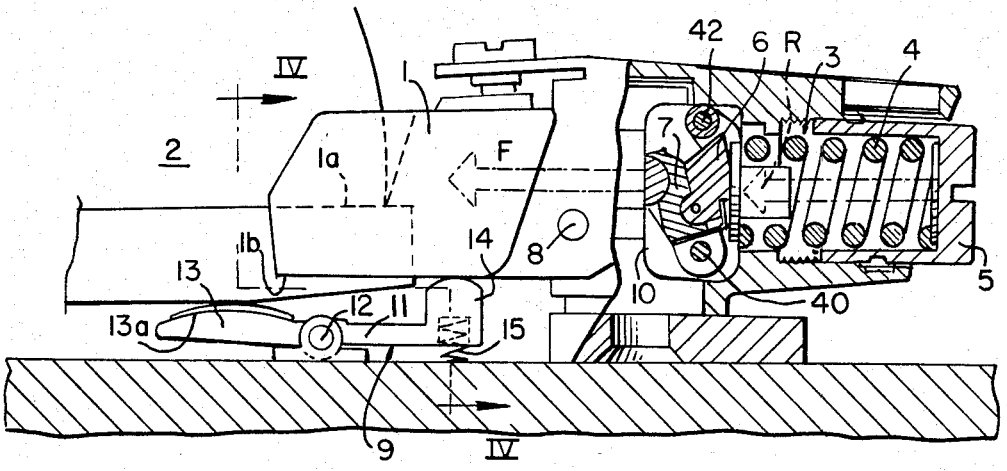
FIG. 1 illustrates a side view partially in vertical and longitudinal cross-section of a safety binding according to the invention in its normal centered rest position for holding the front of the boot when the boot does not experience vertical bias.

Each of the embodiments of the present invention are designed to counteract the dangerous effects of interference forces generated by friction when vertical stress acts on the binding. Each embodiment of the present invention includes: a holding element in the form of a jaw 1 for releasably holding a boot 2 and adapted to laterally pivot; an elastic system 3 for biasing the holding element against lateral pivoting; and a compensation mechanism. The compensation mechanism substantially counteracts the effect of interference forces which bias the holding element against lateral pivoting. The compensation mechanism counteracts the interference forces in the event both upward vertical stress acts on the holding element and downward vertical stress acts on the holding element.

The first embodiment is illustrated in FIGS. 1–4. This binding is of the type described in French Pat. No. 75 19 439, which is hereby incorporated by reference, and which will therefore not be described in detail. The binding comprises a jaw 1 adapted to hold at least a portion of the boot 2, in this case the front portion of the boot, and is adapted to laterally pivot. Jaw 1 is journaled on the body of the binding around transverse axial pin 8 which is transverse to the longitudinal axis of the ski. Jaw 1 comprises a sole gripping element 1*a* which holds the front of ski boot 2.

The binding also includes an elastic locking mechanism or system designated by numeral 3. Elastic system 3 biases jaw 1 against lateral pivoting into a centered retaining position shown in FIG. 1. Elastic system 3 comprises a spring 4 and an adjustment screw 5 adapted to adjust the tension in spring 4. Elastic system 3 exerts a longitudinal force on a support 10 for biasing the jaw against lateral pivoting around support 10. Elastic system 3 exerts its longitudinal force through an intermediate element onto support 10. This intermediate element is part of a biased maintenance mechanism or compensation mechanism.

Elastic system 3 exerts a longitudinal force R, directed toward the rear, on one element 6 of the bias maintenance mechanism. This force is transmitted through element 6 to element 7 which exerts a longitudinal force 7 on support 10. Lateral release and pivoting of the binding, when one vertical stress acts on the binding, occurs when the lateral stress exceeds the release threshold of the binding, which is a function of force F.

The bias maintenance mechanism of the binding maintains the total bias on the jaw against lateral pivoting at substantially the same constant level in the event upwardly directed vertical stress acts on the binding, in the event downwardly directed vertical stress acts on the binding and in the event no vertical stress acts on the binding. A bias maintenance is necessary because the total bias on the jaw against lateral pivoting increases when torsional lateral stresses on the binding are combined with vertical stresses on the binding. When this occurs, the vertical stress generates friction between the boot and the sole gripping element 1*a* or between the boot and ski which increases the bias against lateral pivoting of jaw 1. The bias maintenance mechanism compensates for this additional bias against lateral pivoting by reducing the bias of the elastic system in the event upward vertical stress acts on the binding and in the event downward vertical stress acts on the binding. This is accomplished by a toggle mechanism which is part of the bias maintenance mechanism, for transmitting the longitudinal force R from elastic system 3 to support 10.

The toggle mechanism comprises a first toggle 6 which contacts elastic system 3 and a second toggle 7 which contacts support 10 and toggle 6. Second toggle 7 is journaled on an axial pin 40 which is attached to the body of the binding and which is disposed transverse to the longitudinal axis of the binding. In addition, toggle 6 is journaled on toggle 7. In the position shown in FIG. 1, toggle 6 and toggle 7 abut one another so that substantially all of the force R which is incident upon toggle 6 is transmitted therethrough to toggle 7 without the pivoting thereof, so that force F of toggle 7 on support 10 is substantially equal to force R of elastic system 3 on toggle 6.

Figure 2:
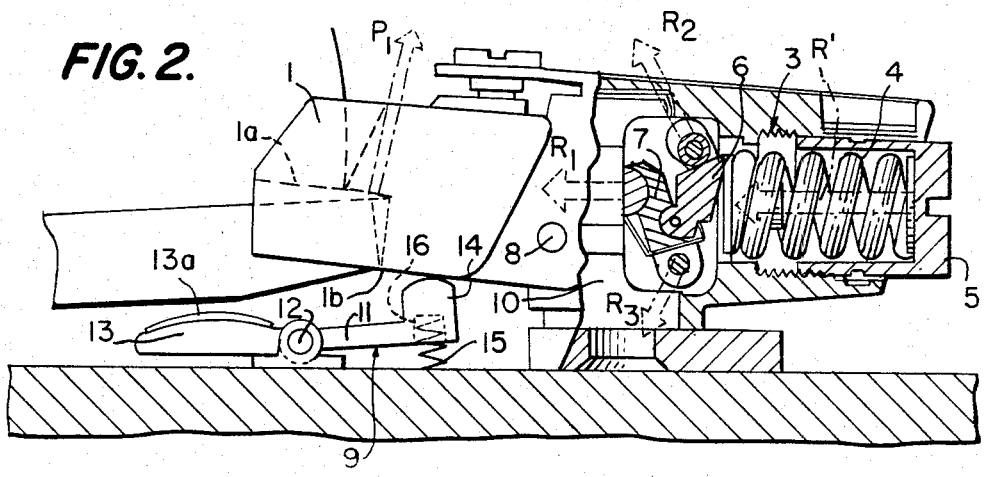
FIG. 2 is a view similar to FIG. 1 when the front of the boot forces the jaw of the binding upward.

Also included in the bias maintenance mechanism is a crosspiece 42 which is attached to jaw 1 on the other side of pin 8 from sole gripping element 1*a*. Thus, when jaw 1 pivots vertically upward crosspiece 42 pivots vertically downward. Crosspiece 42 is so positioned above toggle 6 so that when the binding and the jaw are in their centered retaining position crosspiece 42 does not contact toggle 6; however, when jaw 1 pivots upward crosspiece 42 pivots downward and is forced against toggle 6, thereby forcing toggle 6 to pivot around toggle 7 as seen in FIG. 2. In FIG. 2 the front of the boot is biased upward, for example, as when the skier falls backward and the front of the boot exerts an upward force $P_1$ on the sole gripping element 1*a*. This force gently moves sole gripping element 1*a* clockwise around transverse axial pin 8, thereby pivoting toggle 6 away from toggle 7. This movement of toggle 6 causes force R′ of elastic system 3 on toggle 6 to be split into three forces $R_1$, $R_2$, and $R_3$. Force $R_1$ is the longitudinal force of toggle 7 against support 10. This force $R_1$ is less than the force R′ of elastic system 3 on toggle 6 and less than force F seen in FIG. 1 of toggle 7 on support 10. When the boot is not forced upwardly against the jaw or downwardly against the pedal as seen in FIG. 1, lateral release and pivoting of the binding occurs when the lateral force on the binding exceeds the release threshold which is a function of force F. On the other hand when the boot pivots upwardly, as seen in FIG. 2, the release threshold now depends on $R_1$ which is less than F so that the release threshold has been reduced so as to compensate for interference forces generated by friction of the sole gripping element 1*a* against the boot when sole gripping 1*a* pivots upward. Thus, the toggle mechanism transmits substantially all of the force from the elastic system 3 to support 10 when no vertical stress acts on the jaw and transmits less than all of the force from elastic system 3 to support 10 when vertical stress acts on the jaw 1. The amount of the reduction in the force transmitted from the elastic system to the support is a function of the vertical position of the sole gripping element 1*a* and the intensity of the force exerted on the boot.

In this embodiment, the sole gripping element 1*a* of jaw 1 acts as a sensor for detecting upward stresses on the boot and binding (i.e., $P_1$) and for activating the toggle mechanism which is responsive to the vertical position of sole gripping element 1*a*.

Figure 3:
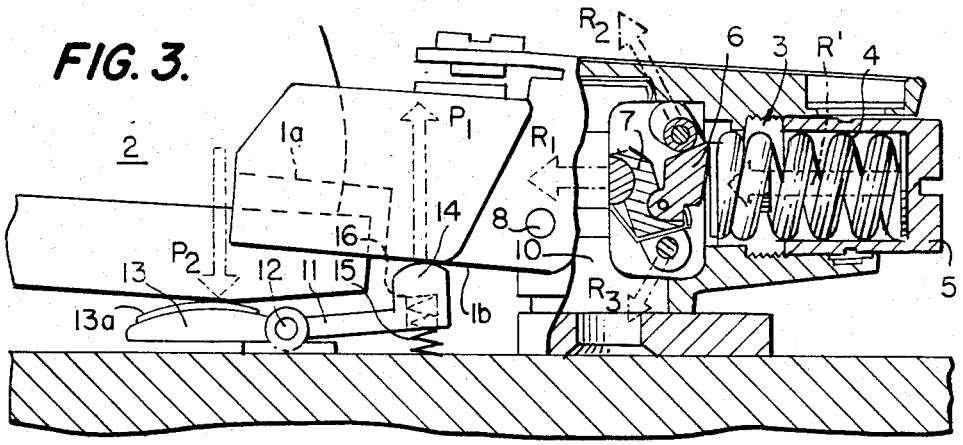
FIG. 3 is similar to FIG. 1 when the front of the boot exerts a downward force, in the direction of the ski.
Figure 4:
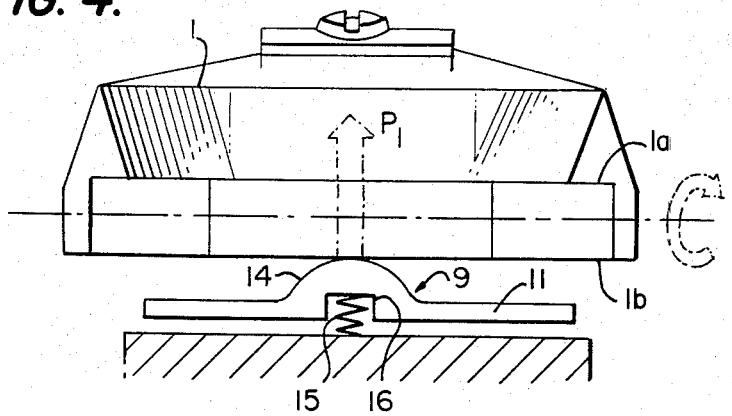
FIG. 4 illustrates a vertical and transverse cross-section along line IV—IV of FIG. 1.

Also provided in this embodiment is a second sensor 9 which is adapted to be located on the ski and under front of boot 2 for detecting downward directed vertical forces and activating the toggle mechanism so as to compensate for the frictional forces. Sensor 9 comprises a lever having two arms 11 journaled on an axial pin 12 whose axis around which the lever pivots is transverse to the longitudinal axis of the ski. A first portion of the lever 13 is adapted to be disposed between the sole of the boot and the ski, or in other words is located under the sole of the boot. This first portion of the lever comprises a pedal 13 having an anti-friction plate 13*a* on the top thereof. The preferred shape of anti-friction plate 13*a* is convex. The second portion of lever 11, which comprises a projection 14 on the rest portion of lever 11, is disposed on the opposite side of pin 12 from pedal 13 and is adapted to be disposed under the first sensor on the bottom of the sole gripping element 1*a* of jaw 1. Thus, when the boot pivots pedal 13 downwards, projection 14 pivots upward. Sensor 9 is adapted to be permanently biased by an elastic mechanism comprising a small compression release spring 15 so as to bias projection 14 counterclockwise against the bottom 1*b* of the sole gripping element 1*a*. Spring 15 is adapted to rest on top of the ski at one end, and the other end of spring 15 is adapted to engage a recess in projection 14. Thus, projection 14 is always in contact with bottom 1*b* of sole gripping element 1*a* due to the bias of spring 15. If the skier falls forward as seen in FIG. 3, the front of boot 2 is stressed downward in the direction of the ski which thereby directs a force $P_2$ against pedal 13 to push pedal 13 in the downward direction. This causes lever 11 to pivot counterclockwise around axial pin 12. The projection 14 located on the back end of lever 11 pivots upward, and because it is in contact with the bottom 1*b* of sole gripping element 1*a*, it causes sole gripping element 1*a* in jaw 1 to pivot clockwise around axial pin 8, just as an upward bias on sole gripping element 1*a* would cause it to pivot clockwise around axial pin 8. Stated in another way, sensor 9 intervenes as an intermediate element between boot 2 and the sole gripping element 1*a* of jaw 1 so as to translate a downward force and movement into an upward force and movement which is then transferred to the first sensor comprising the sole gripping element 1*a*. Just as in the case of a purely upward stress on the binding, a downward stress transformed into an upward stress by sensor 9 reduces the value of the longitudinal force F of the toggle on the support so as to reduce the lateral release threshold as in FIG. 2.

Figure 5:
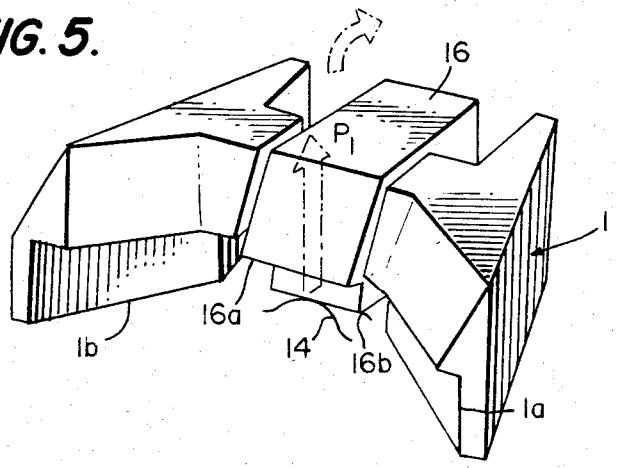
FIG. 5 is a perspective view of an embodiment wherein the first sensor which detects upward stresses is independent of the sole gripping element.
Figure 6:
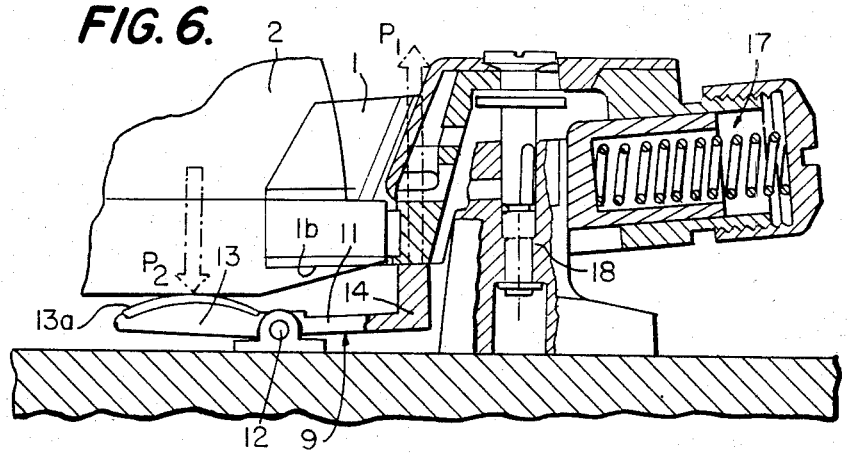
FIG. 6 is a side view, partially in vertical and longitudinal cross-section, of another embodiment of a safety binding according to the invention in its normal centered rest position when holding the front of the boot.
Figure 7:
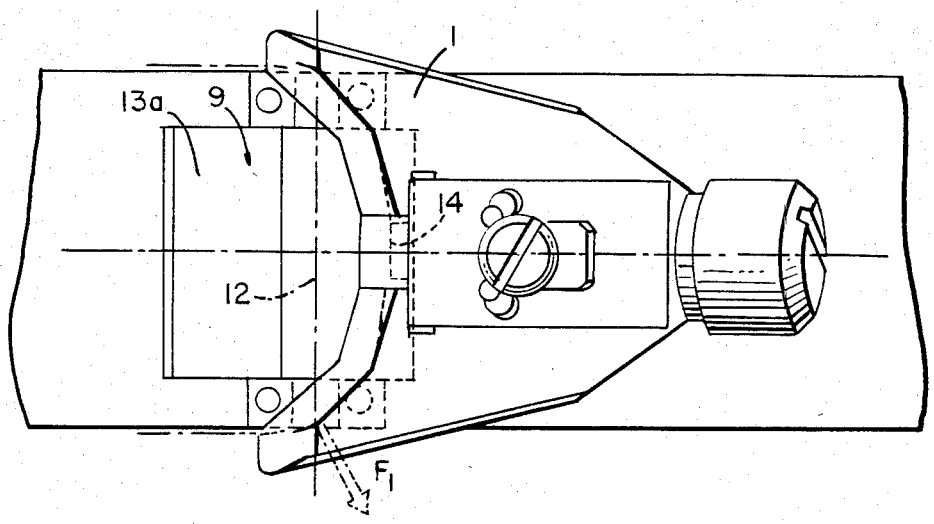
FIG. 7 illustrates a top plan view of the binding in FIG. 6.
Figure 8:
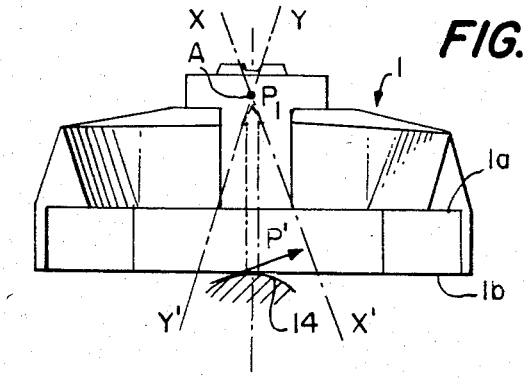
FIG. 8 is a front profile view of the binding's jaw assembly, taken to the left of FIG. 7.
Figure 9:
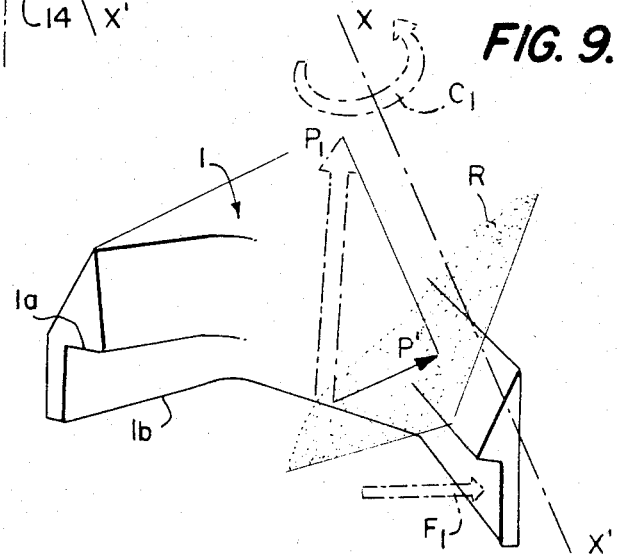
FIG. 9 illustrates a schematic perspective view of the operation of the binding shown in FIGS. 6 through 8.

In the embodiment shown in FIGS. 1–4, the sole gripping element 1*a* acts as a sensor to directly detect upward stresses and to activate the toggle mechanism. FIG. 5 illustrates another embodiment wherein the sole gripping element 1*a* no longer acts as a sensor and activating mechanism for the toggle. Rather, an independent sensor 16 or vertical stress detecting mechanism, independent from sole gripping element 1*a*, acts to sense upward vertical stresses on the binding and to activate the toggle mechanism as in the embodiment shown in FIGS. 1–4. Thus, crosspiece 42 is now connected to sensor 16 and sensor 16 pivots around the transverse axial pin 8. Sensor 16 has a first lower side 16*a* in the form of a shoulder which is adapted to be in contact with the top edge of the sole of the boot in order to directly detect upward stresses and activate the toggle mechanism. Sensor 16 has another face 16*b* which is in contact with the projection 14 of sensor 9 so as to detect downward stresses and activate the toggle mechanism to reduce the bias of elastic system 3 against the lateral pivoting of jaw 1.

FIGS. 6–9 illustrate another embodiment of the present invention. This embodiment relates to a compensation binding of the type described in French Pat. Nos. 75 37 908, 78 08 805, 78 08 342, 79 14 484 and 80 06 365 of the applicant which are hereby incorporated by reference. Thus, this binding will not be discussed in detail. The binding comprises a jaw 1 adapted to hold at least a portion of boot 2 and adapted to pivot laterally. When the jaw experiences vertical stress, friction is generated which biases the jaw against lateral pivoting. An elastic system 3 also biases the jaw against the lateral pivoting. The binding further includes a compensating means for causing a compensating lateral force to act on the jaw to compensate for bias against lateral pivoting caused by the friction. This compensating lateral force is produced when upward vertical stress acts on the jaw and when downward vertical stress acts on the jaw. This compensating mechanism comprises a support 18 attached to the ski and a portion of the jaw which is adapted to engage the support. The rear of support 18 comprises two lateral lines of support, XX′ and YY′, converging above the ski. The jaw is adapted to pivot laterally around either one of these lines of support. When the jaw experiences upward directed vertical stress, this compensating lateral force is produced as will be described herein below.

Jaw 1 is biased by elastic mechanism 17 to contact the two lateral lines of support, XX′ and YY′ located on the back of the support element 18 which is attached to the ski. These two lateral lines of support XX′ and YY′ converge at a point A above the ski as is schematic shown in FIG. 8. The compensating lateral force is generated as follows: when jaw 1 is subjected to an upward stress $P_1$, this upward stress or force $P_1$ has a component P′ which causes jaw 1 to pivot around one of the two lines of support. This component P′ is the projection of force $P_1$ on a plane R perpendicular to a support line, for example, XX′ seen in FIG. 9 around which the jaw pivots during a lateral pivoting and release of the boot in the direction indicated by arrow $C_1$ in FIG. 9. $P_1$ is the lateral compensating force which compensates for the interference forces. This lateral compensating force P′ is combined with force $F_1$ which is a lateral force caused by lateral torsional stress on the boot so as to overcome the interference forces and pivot the jaw laterally around one of the two lines of support.

In this embodiment, the binding also comprises, as illustrated in FIGS. 1–5, a second sensor 9 located on the ski which is adapted to detect and transform downward directed vertical stress into upward directed vertical stress acting on the jaw. Sensor 9 comprises the same structure as shown in FIGS. 1–5. It comprises a lever 11 journaled around a pin 12 and having a first portion which is a back pedal 13 on one side of pin 12 and a forward projection 14 on the other side of pin 12. Pedal 13 has a convex anti-frictional plate 13*a*. Pedal 13 is activated by the sole of the boot so that when the sole of the boot pushes down with a force $P_2$ on pedal 13, projection 14 pivots upward against the bottom 1*b* of jaw 1 to exert an upward force $P_1$ on the jaw during a fall forward so as to produce a compensating lateral force P′. This additional lateral compensation force is generated during a forward as well as a backward fall, and this compensating force in combination with lateral stresses due to torsional forces compensates for the interference frictional forces generated by vertical stresses on the binding which result from the pressing of the sole either on the sole gripping element 1*a* when the fall is backwards or on the ski when the fall is forward.

Figure 10:
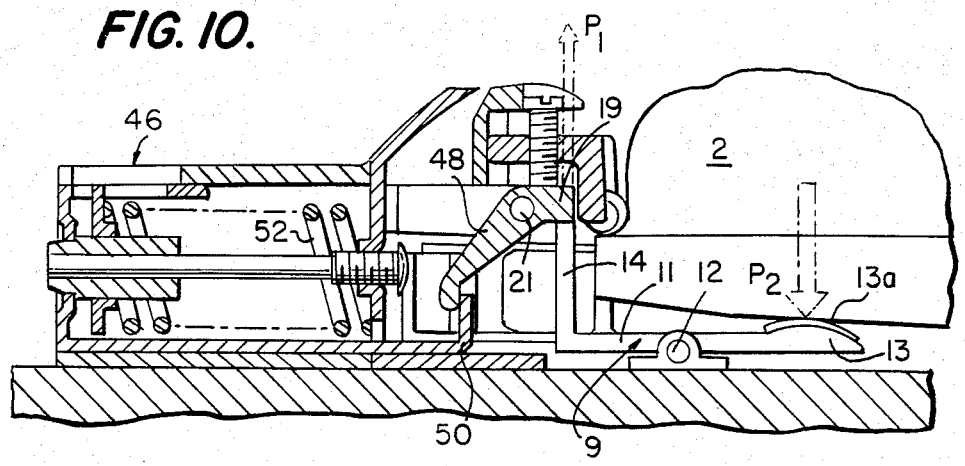
FIG. 10 is a longitudinal cross-sectional side view of another embodiment of a safety binding according to the invention in its normal centered rest position when holding the front of the boot.

FIG. 10 illustrates another embodiment of the present invention, showing a safety binding of a type described in French Pat. No. 73 44 810 which is hereby incorporated by reference. This binding will therefore not be described in detail. The binding comprises a holding mechanism or jaw 1 for releasably holding a boot to a ski and adapted to laterally pivot. When vertical stress acts on the holding mechanism, friction is produced which generates interference forces biasing the holding mechanism against lateral pivoting. Also included is an elastic system 46 for biasing the holding mechanism or jaw 1 against lateral pivoting. Also provided is a compensation mechanism for substantially counteracting the effect of the interference forces when an upward directed and a downward directed vertical stress act on the holding mechanism. Part of this compensation mechanism comprises a lever 19 which is journaled on an axial pin 21 whose longitudinal axis is transverse to the longitudinal axis of the binding and the ski. When an upward stress acts on lever 19, it pivots counterclockwise so that its arm 48 pulls lever 50 forward thereby expanding springs 52 to decrease the bias of the jaw against lateral pivoting due to the springs. Thus, lever 19 acts as a first sensor which compensates for interference frictional forces by reducing the bias against lateral pivoting of jaw 1 due to elastic system 46. The present invention also includes a second sensor 9 adapted to be located under the sole of boot 2. Sensor 9 includes as in the embodiments seen in FIGS. 1–5, a lever 11 journaled on a pin 12 having a pedal 13 under boot 2 and a projection 14 on the other side of pin 12 so that when a vertical force $P_2$ acts in the downward direction on pedal 13, projection 14 pivots upward and exerts an upward force $P_1$ against lever 19 thereby pivoting lever 19 counterclockwise.

FIGS. 11–16 represent alternative embodiments of this second sensor 9 for transforming a downward stress $P_2$ directed toward the ski into an upward stress $P_1$ directed upward on the compensating mechanism of the binding.

Figure 11:
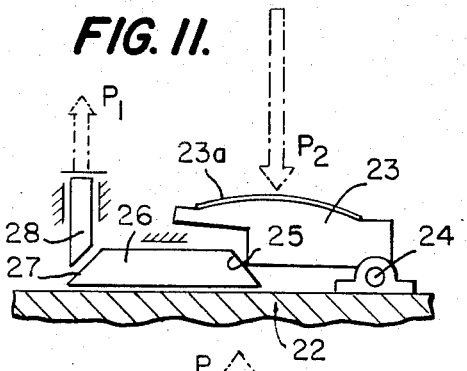
FIGS. 11, 12, 13, 14, 15, 16 are schematic diagrams illustrating various embodiments of the second sensor in FIG. 10 detecting stresses exerted in the direction of the ski.

In FIG. 11, this second sensor is a sensor 22 and comprises a first element or pedal 23 journaled on its bottom rear section with the ski around a transverse axial pin 24 and having a convex anti-friction plate 23*a* on the top thereof. The front section of pedal 23 rests on a rear inclined face 25 of a second element or incline slide 26. Slide 26 is adapted to be longitudinally movable along the ski and contains an inclined front face 27 which is adapted to engage the lower end of a third element or pushing element 28 which is adapted to move vertically and push against the first sensor 19. Thus, the pivoting of pedal 23 in the direction of the ski causes the horizontal displacement of slide 26 in the forward direction thereby pushing element 28 upward with a force $P_1$ against the first sensor.

Figure 12:
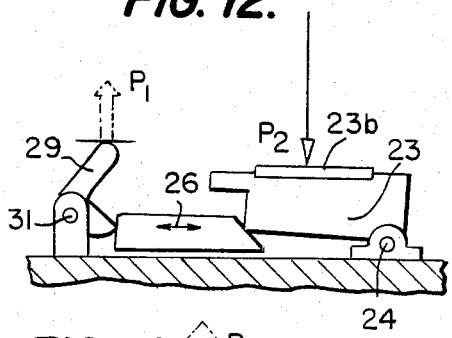

In the embodiment shown in FIG. 12, pedal 23 has a flat anti-friction plate 23*b* on top thereof. In addition, slide 26 acts on a lever 29 having two arms which are journaled around a horizontal and transverse axial pin 31 therebetween. The upper arm of lever 29 exerts a force $P_1$ directed upward on the first sensor when the boot exerts a force $P_2$ downward on pedal 23. FIG. 12 shows the second sensor after a downward stress $P_2$ has acted on pedal 23 and lever 29 has rotated to provide upward force $P_1$.

Figure 13:
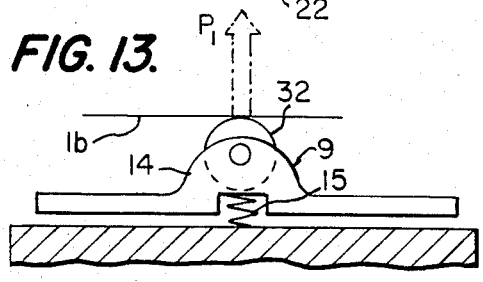
Figure 13A:
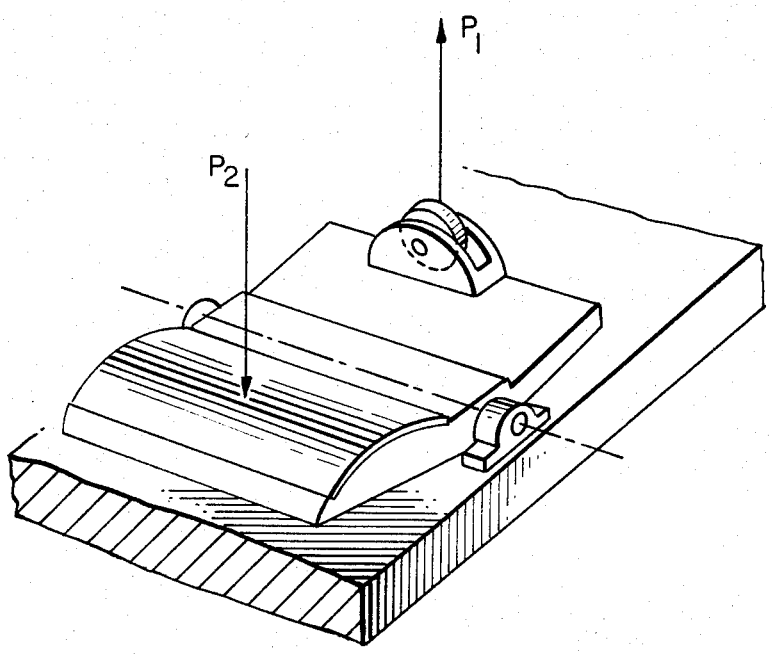
FIGS. 13A and 14A show respectively, perspective side views of the invention in FIGS. 13 and 14.

FIG. 13 and FIG. 13A illustrate another embodiment in which the second sensor 9 has a projecting roller 32 projecting above the center of sensor 9 and which contacts the bottom 1*b* of sole gripping element 1*a* to exert a force $P_1$ upward on its projection 14 when downward force $P_2$ is exerted on second sensor 9. 1 As can be seen from FIG. 13, spring 15 which is in contact with the ski and a recessed in sensor 9 is adapted to bias sensor 9 upward against the bottom of the sole gripping element.

Figure 14:
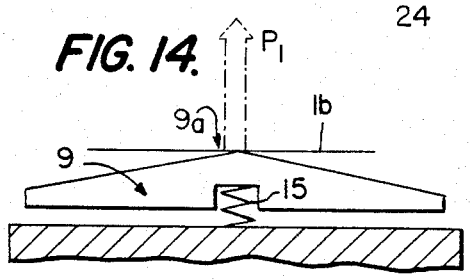
Figure 14A:
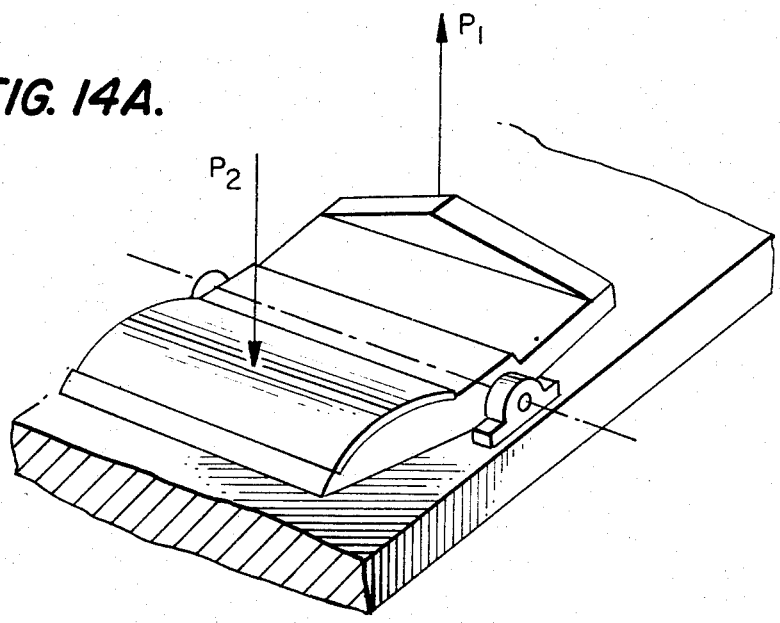

FIG. 14 and FIG. 14A illustrate an embodiment of the second sensor 9 wherein the sensor 9 is in the form of a lever in the shape of an inverted V with a very wide angle between the two legs thereof. The apex of the V, called edge 9*a*, is in contact with the bottom 1*b* of the sole gripping element 1*a* and is adapted to be biased into contact therewith by spring 15 which engages a recess in the bottom of sensor 9. When a force $P_2$ acts downward on sensor 9 at one end thereof, the other end of sensor 9, which has edge 9*a* thereon, exerts a force $P_1$ upward against bottom 1*b* of sole gripping element 1*a*.

Figure 15:
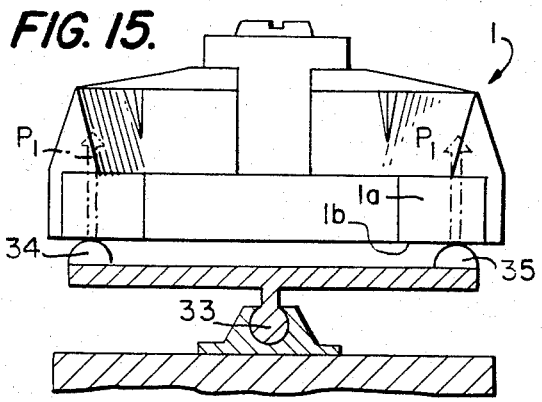
Figure 16:
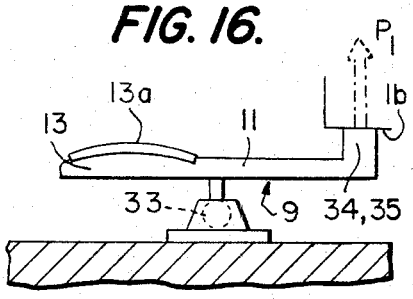

FIGS. 15 and 16 illustrate another embodiment of second sensor 9 wherein the lever 11 is journaled in a socket which is spherical. Lever 11 comprises on its front portion, two lateral projections 34 and 35 at each transverse end thereof. Projections 34 and 35 are respectively adapted to be located under the lateral parts of the sole gripping element 1*a* by contacting the bottom 1*b* of the sole gripping element. On the back portion of lever 11 on the other side of spherical joint 13, is located pedal 13 having a convex anti-friction surface 13*a*. When a downward directed force acts on pedal 13, lever 11 pivots so that projections 34 and 35 exert an upward vertical force $P_1$ against sole gripping element 1*a*.

It should be noted that although the present invention was described with respect to a toe binding which engages the front of the boot, the present invention can also be practiced on a binding which holds the heel or rear of the boot.

The invention has been described with respect to particular preferred embodiments. It is to be understood, however, that the invention is not limited to the particular apparatus disclosed and that various modifications may be made in the apparatus without departing from the scope of the invention.

I claim:

1. A safety binding for holding a boot on a ski, comprising:

a jaw adapted to hold at least a portion of said boot, and adapted to laterally pivot;

an elastic system for biasing said jaw against lateral pivoting; and a bias maintenance means for maintaining the total bias on said jaw against lateral pivoting at substantially the same level in the event upwardly directed vertical stress acts on said binding, in the event a downwardly directed vertical stress acts on said binding, and in the event no vertical stress acts on said binding, wherein said bias maintenance means is adapted to reduce said bias caused by said elastic system when upward directed vertical stress acts on said binding, wherein said bias maintenance means is adapted to reduce said bias caused by said elastic system when downward vertical stress acts on said binding, and wherein said binding further comprises a support, wherein said elastic system is adapted to produce a force on said support for biasing said jaw against lateral pivoting, and wherein said bias maintenance means comprises a toggle means for transmitting substantially all of said force from said elastic system to said support when no vertical stress acts on said jaw, and for transmitting less than all of said force from said elastic system to said support when vertical stress acts on said jaw.

2. The binding of claim 1 wherein said toggle means comprises:

a first toggle adapted to contact said elastic system; and a second toggle adapted to pivot around an axis transverse to the longitudinal axis of said binding, wherein said first toggle is adapted to be journaled on said second toggle.

3. The binding of claim 2 wherein said jaw includes a sole gripping means for gripping the sole of said boot and wherein said jaw is adapted to pivot upwards around an axis and said toggle means further comprises a crosspiece, connected to said jaw on the opposite side of said axis from said sole gripping means around which said jaw pivots, and positioned so that when said jaw pivots upward, said crosspiece forces said first toggle to pivot away from said second toggle.

4. The binding of claim 2 wherein said binding further includes a vertical stress detecting means for detecting upward directed stress wherein said detecting means is adapted to pivot upward in response to vertical stress and wherein the amount of force transmitted by said toggle is determined by the vertical position of said vertical stress detecting means.

5. The binding of claim 4 wherein when said detecting means is in its centered rest position, said first and second toggles abut one another and when said detecting means pivots upward away from its centered rest position said first toggle pivots away from said second toggle.

6. The binding of claim 5 wherein a boot contacting portion of said detecting means is adapted to contact said boot and wherein said detecting means is adapted to pivot around an axis and said binding further includes a crosspiece connected to said detecting means on the side of said axis opposite from said boot contacting portion, wherein said crosspiece is so positioned that when said jaw pivots upward, said crosspiece forces said first toggle to pivot away from said second toggle.

7. The binding of claim 6 wherein said jaw includes a sole gripping means for gripping the sole of the boot and said detecting means includes a shoulder adapted to contact said boot, and said detecting means operates independently from said sole gripping element.

8. The binding of claim 7 further including a sensor adapted to sense downward directed vertical forces and adapted to convert said downward directed vertical forces into upward directed vertical forces acting on said detecting means.

9. The binding of claim 8 further including an elastic means and wherein said sensor comprises a lever adapted to pivot around an axis, wherein a first portion of said lever on one side of said axis is adapted to be disposed between said ski and the sole of said boot, and a second position of said lever, on the other side of said axis is adapted to be disposed between said ski and detecting means and is adapted to be biased by said elastic means against said detecting means.

10. The binding of claim 1 wherein said jaw is adapted to pivot vertically, wherein said toggle means is responsive to the vertical position of said jaw, and wherein when said jaw pivots vertically upward from a centered rest position, said toggle means transmits less than all of said force from said elastic system to said support.

11. The binding of claim 10 wherein said jaw includes a sole gripping means for gripping the sole of said boot, wherein said sole gripping means comprises a first sensor for detecting upwardly directed vertical forces and activating said toggle means.

12. The binding of claim 11 further including a second sensor adapted to detect downward directed vertical forces and adapted to convert said downward forces to upward directed vertical forces acting on said first sensor.

13. The binding of claim 12 wherein said second sensor comprises a lever journaled on a pin wherein a first portion of said lever is adapted to be disposed between the sole of said boot and the ski on one side of said pin and a second portion of said lever is adapted to be disposed on the other side of said pin under said first sensor, whereby, when said boot pivots said first portion downward, said second portion pivots upward against said first sensor.

14. The binding of claim 13 wherein said first portion of said lever comprises a pedal having an anti-friction plate on top thereof.

15. The binding of claim 14 wherein said anti-friction plate is convex in shape.

16. The binding of claim 14 wherein said second portion comprises a projection and further including an elastic system adapted to bias said projection against said first sensor.

17. The binding of claim 16 wherein said elastic means is a spring and wherein said projection has a recess in the bottom thereof, wherein said spring is adapted to engage said recess.

18. A safety binding for holding a boot on a ski, comprising:

a jaw adapted to hold at least a portion of said boot and adapted to pivot laterally, wherein when said jaw experiences vertical stress, friction is generated which biases said jaw against lateral pivoting;

an elastic system for biasing said jaw against lateral pivoting;

a compensating means for causing a compensating lateral force to act on said jaw to compensate for said bias against lateral pivoting caused by said friction, wherein said compensating lateral force is produced both in the event upward vertical stress acts on said jaw and downward vertical stress acts on said jaw, and wherein said compensating means comprises a sensor adapted to be positioned under said boot, for detecting vertical stress.

19. The binding of claim 18 wherein said compensating means comprises:

a support attached to said ski having two lines of support thereon, converging above said ski; and a portion of said jaw, adapted to engage said support, and adapted to pivot laterally around either of said lines of support, whereby when said jaw experiences upward directed vertical stress said compensating lateral force is produced.

20. The binding of claim 19 further including a sensor adapted to detect and transform downward directed vertical stress into upward directed vertical stress acting on said jaw.

21. The binding of claim 20 wherein said sensor comprises a lever adapted to pivot around an axis wherein a first portion of said lever on one side of said axis is adapted to be disposed between said ski and said boot, and a second portion of said lever on the other side of said axis is adapted to be disposed between said ski and said jaw.

22. The binding of claim 21 wherein said first portion comprises a pedal having a convex top portion.

23. A safety binding for holding a boot to a ski, comprising:

a support attached to a ski, and having two lines of support thereon, converging above said ski, a holding means for releasably holding a boot to a ski, wherein said holding means is adapted to laterally pivot about either one of two lines of support whereby when said jaw experiences upward directed vertical stress, a lateral force is produced urging said jaw to pivot laterally; and a sensor for sensing downward directed vertical stress and converting said downward directed vertical stress to upward directed vertical stress acting on said jaw.

24. The binding of claim 23 wherein said sensor is positioned under said boot.

25. A safety binding for holding a boot on a ski comprising:

holding means for releasably holding a boot to a ski and adapted to laterally pivot, wherein when vertical stress acts on said holding means, friction is produced which generates interference forces biasing said holding means against lateral pivoting;

elastic means for biasing said holding means against lateral pivoting;

compensation means for substantially counteracting the effect of said interference forces both in the case of an upward directed vertical stress acting on said holding means and a downward directed vertical stress acting on said holding means, and wherein said compensation means comprises a sensor adapted to be positioned under said boot for detecting vertical stress.

26. The binding of claim 25 wherein said compensation means comprises a first sensor for detecting upward vertical stresses on said holding means and adapted to transmit said upward vertical stresses to the rest of said compensation means.

27. The binding of claim 26 wherein said first sensor comprises a lever adapted to pivot about an axis transverse to the longitudinal axis of said binding.

28. The binding of claim 27 further including a sole gripping means for gripping the sole of said boot and a second sensor for transforming downward directed vertical stress to upward directed vertical stress, wherein said second sensor comprises a lever having a roller projecting above the center thereof and adapted to contact said sole gripping element.

29. The binding of claim 27 further including a sole gripping means for gripping the sole of said boot, and a second sensor for transforming downward directed vertical stress to upward directed vertical stress acting on said binding.

30. The binding of claim 29 wherein said second sensor is a lever having an inverted V shape with an apex, wherein the apex of said lever is adapted to contact said sole gripping element.

31. The binding of claim 29 wherein said second sensor comprises a lever journaled on said ski about an axis transverse to the longitudinal axis thereof having a projection at each transverse end thereof, each adapted to contact said sole gripping element, and further including a pedal having an anti-friction convex top portion, wherein said pedal is on the opposite side of said axis from said projections, and said pedal is adapted to contact said sole gripping element.

32. The binding of claim 27 further including a second sensor for transforming downward directed vertical stress into upward directed vertical stress acting on said lever.

33. The binding of claim 32 wherein said second sensor comprises a lever adapted to pivot around an axis transverse to the longitudinal axis of said ski, wherein said lever comprises a first portion adapted to be placed under said boot, and a second portion, on the other side of said axis from said first portion, adapted to be placed under said first sensor.

34. The binding of claim 32 wherein said first portion of said lever comprises a pedal having a convex top portion.

35. The binding of claim 33 wherein said second sensor comprises:

a first element adapted to pivot around an axis transverse to the longitudinal axis of said ski;

a second element adapted to move along a longitudinal axis of said ski in response to pivoting of said first element in response to a downward directed stress; and a third element adapted to move vertically in response to the longitudinal movement of said second element to vertically move a portion of said first sensor.

36. The binding of claim 35 wherein said first element is journaled on said ski and includes a front portion, said second element has front and rear inclined faces wherein said front portion of said first element is adapted to contact said rear inclined face of said second element and said front inclined face of said second element is adapted to contact said third element.

37. The binding of claim 35 wherein said first element includes an anti-friction convex top surface.

38. The binding of claim 35 wherein said third element comprises a lever having two arms pivoting around an axis therebetween, transverse to the longitudinal axis of said ski.

39. A safety binding for holding a boot on a ski, comprising:

a jaw adapted to hold at least a portion of said boot, and adapted to laterally pivot;

an elastic system for biasing said jaw against lateral pivoting; and a bias maintenance means for maintaining the total bias on said jaw against lateral pivoting at substantially the same level in the event upwardly directed vertical stress acts on said binding, in the event a downwardly directed vertical stress acts on said binding, and in the event no vertical stress acts on said binding, and wherein said bias maintenance means comprises a sensor, adapted to be positioned under said boot, for detecting vertical stress.

* * * * *